US007575235B2

(12) United States Patent
Belill

(10) Patent No.: US 7,575,235 B2
(45) Date of Patent: Aug. 18, 2009

(54) PLAYING CARD APPARATUS AND METHOD OF CONCEALING AND DISPLAYING PLAYING CARDS

(76) Inventor: Francis G. Belill, 13203 Golden Ct., Fenton, MI (US) 48430

( * ) Notice: Subject to any disclaimer, the term of this patent is extended or adjusted under 35 U.S.C. 154(b) by 394 days.

(21) Appl. No.: 11/322,009

(22) Filed: Dec. 29, 2005

(65) Prior Publication Data

US 2006/0163808 A1 Jul. 27, 2006

Related U.S. Application Data

(60) Provisional application No. 60/647,696, filed on Jan. 27, 2005.

(51) Int. Cl.
*A63F 1/00* (2006.01)

(52) U.S. Cl. ..... 273/292

(58) Field of Classification Search ..... 273/150
See application file for complete search history.

(56) References Cited

U.S. PATENT DOCUMENTS 1,590,463 A * 6/1926 Wood ..... 472/63
3,165,319 A * 1/1965 Benima ..... 273/293
3,236,523 A * 2/1966 Stein ..... 273/148 R
3,817,530 A * 6/1974 Howard ..... 273/281
4,146,229 A * 3/1979 Morse ..... 273/150
4,353,555 A * 10/1982 Flam ..... 273/148 R
5,312,104 A * 5/1994 Miller ..... 273/148 R
5,362,053 A * 11/1994 Miller ..... 273/148 R
5,967,894 A * 10/1999 Kinoshita et al. ..... 463/13
6,886,829 B2 * 5/2005 Hessing et al. ..... 273/149 R
2006/0033270 A1 * 2/2006 Grauzer et al. ..... 273/149 R
2006/0163816 A1 * 7/2006 Moody ..... 273/292
2006/0279040 A1 * 12/2006 Downs et al. ..... 273/149 R
2007/0018389 A1 * 1/2007 Downs ..... 273/149 R

* cited by examiner

*Primary Examiner*—Gene Kim
*Assistant Examiner*—Dolores Collins
(74) *Attorney, Agent, or Firm*—Reising Ethington, P.C.

(57) ABSTRACT

A playing card apparatus and method for discreetly displaying values on faces of playing cards while in a face down orientation to a player. The apparatus has a housing with a playing card support surface with an opening over which the playing cards are placed face down. A first mirror is positioned below the opening to reflect an image of the playing card values in one direction while in their face down orientation. A second mirror is positioned below the opening to reflect the image from the first mirror upwardly through the opening for discreet viewing by the player.

12 Claims, 7 Drawing Sheets

PLAYING CARD APPARATUS AND METHOD OF CONCEALING AND DISPLAYING PLAYING CARDS

REFERENCE TO CO-PENDING APPLICATION

This application claims the benefit of, and incorporates by reference in its entirety, U.S. Provisional Application Ser. No. 60/647,696, filed Jan. 27, 2005.

BACKGROUND OF THE INVENTION

1. Field of the Invention

This invention relates generally to playing cards, and more particularly to apparatus used for concealing playing cards from unwanted viewing.

2. Related Art

While playing card games, such as poker or blackjack, typically at least one card is dealt face down on a playing surface for intended viewing by the player dealt the cards. To view the face down cards, typically the player carefully picks the cards up from the playing surface, cups them in their hands, and carefully views the cards while attempting to prevent others from seeing the cards. Unfortunately, this can result in an unintentional display of the cards to other players, or to bystanders standing to the side or behind the player. Rather than picking the cards up from the playing surface, the player dealt the cards may elect to bend a corner of the cards upwardly to see the card number and suit, while leaving the remaining portion of the cards face down on the playing surface. As with picking the cards up, this too can result in an unintentional display of the cards. In addition to causing an unintended display, the cards tend to become bent or deformed from their being bent or cupped. Generally, regardless of how a player attempts to view their face down cards, it is difficult to avoid unwanted exposure to other persons, and to avoid damage or excessive wear to the cards.

SUMMARY OF THE INVENTION

A playing card apparatus for discreetly displaying values on faces of playing cards to a player has a housing with a playing card support surface with at least one opening over which the playing cards are placed face down. A first mirror is positioned below the opening to reflect an image of the playing card values in one direction while in their face down orientation. A second mirror is positioned below the opening to reflect the image from the first mirror upwardly through the opening for discreet viewing by the player.

Another aspect of the invention provides a method of concealing and displaying playing cards. The method includes placing at least one playing card face down on a housing having a playing card support surface with at least one opening sized to view the value of the playing cards therethrough. The housing further includes a first mirror positioned below the opening to reflect an image of the playing card values in one direction, and a second mirror positioned below the opening to reflect the image from the first mirror upwardly through the opening. The method further includes viewing the value of the playing card through the opening.

BRIEF DESCRIPTION OF THE DRAWINGS

Some of the objects, features and advantages of the invention will become readily apparent in view of the following detailed description of presently preferred embodiments and best mode, appended claims, and accompanying drawings, in which:

DETAILED DESCRIPTION OF PREFERRED EMBODIMENTS

Referring in more detail to the drawings, FIGS. 1 and 9-11, illustrate a playing card apparatus 10 for discreetly displaying a playing card number and suit, referred to hereafter simply as value, of at least one, and shown here as a pair of playing cards 12, for example, to a player while the cards 12 remain in a face down orientation. The apparatus 10 allows the player to view the value of the cards 12 without having to lift the cards 12 into plain view of others or without having to bend the cards 12 for viewing the value, as is customary. As such, the risk of others seeing the value of the cards 12 is eliminated, and the likelihood of the cards 12 becoming damaged or excessively worn in use is reduced. The apparatus 10 is useful in any card game in which a player desires the value of at least one playing card to remain secretive and hidden from the view of others, such as, by way of example and without limitations, in a poker game known as, Texas Hold'em, or variations thereof, wherein a player generally desires the value of a pair of dealt playing cards to remain hidden from view of others.

Figure 1:
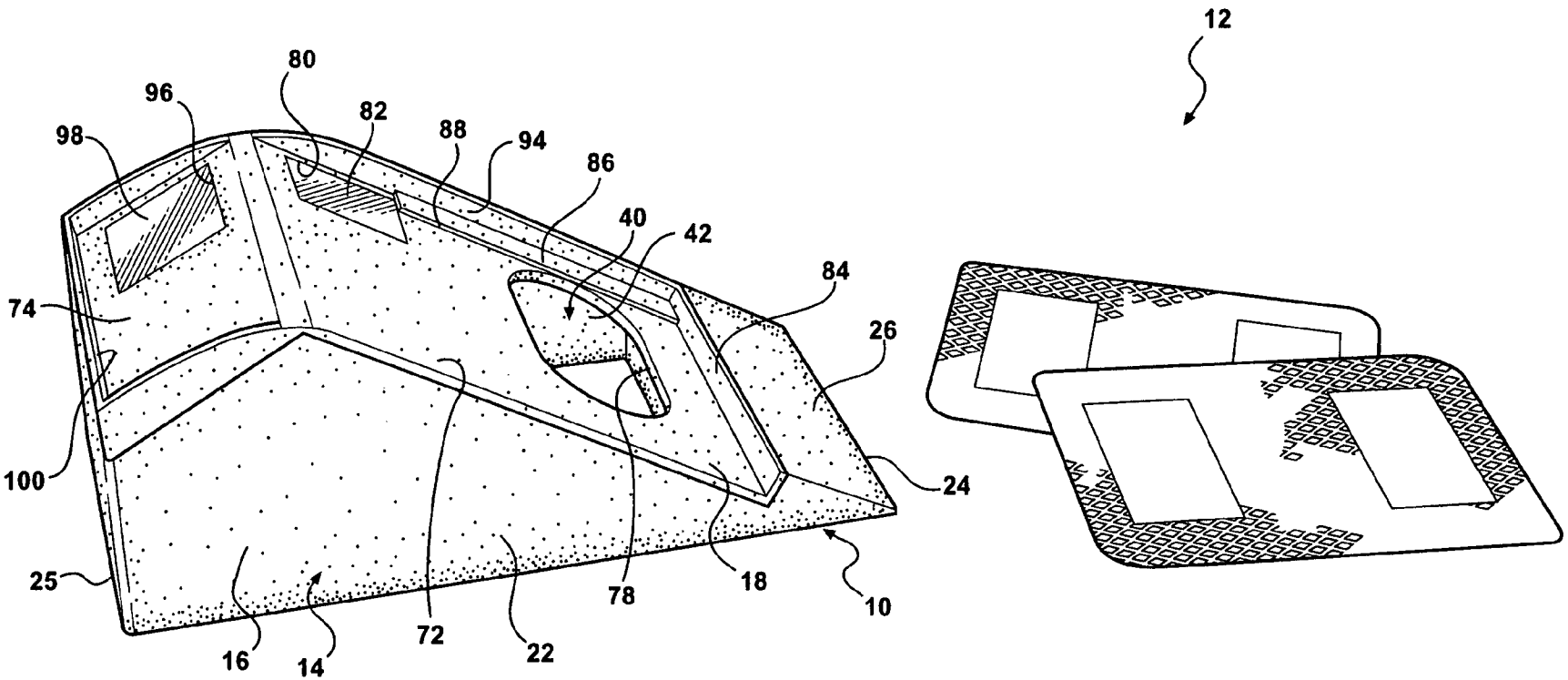
FIG. 1 is a side perspective view of a playing card apparatus constructed according to one presently preferred embodiment with a pair of playing cards disposed face down in front thereof.
Figure 2:
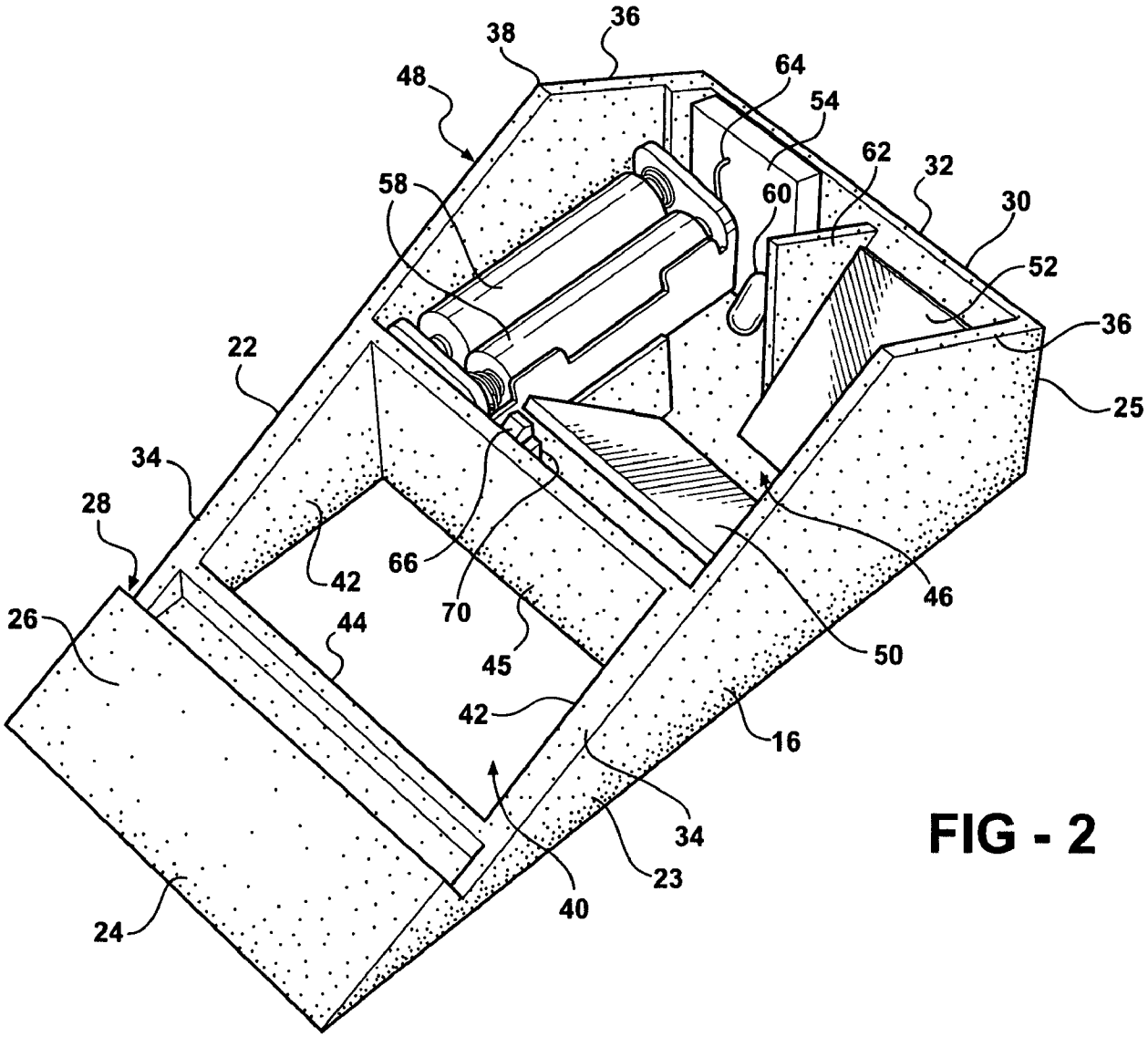
FIG. 2 is a front perspective view of the playing card apparatus with a cover removed therefrom.
Figure 3:
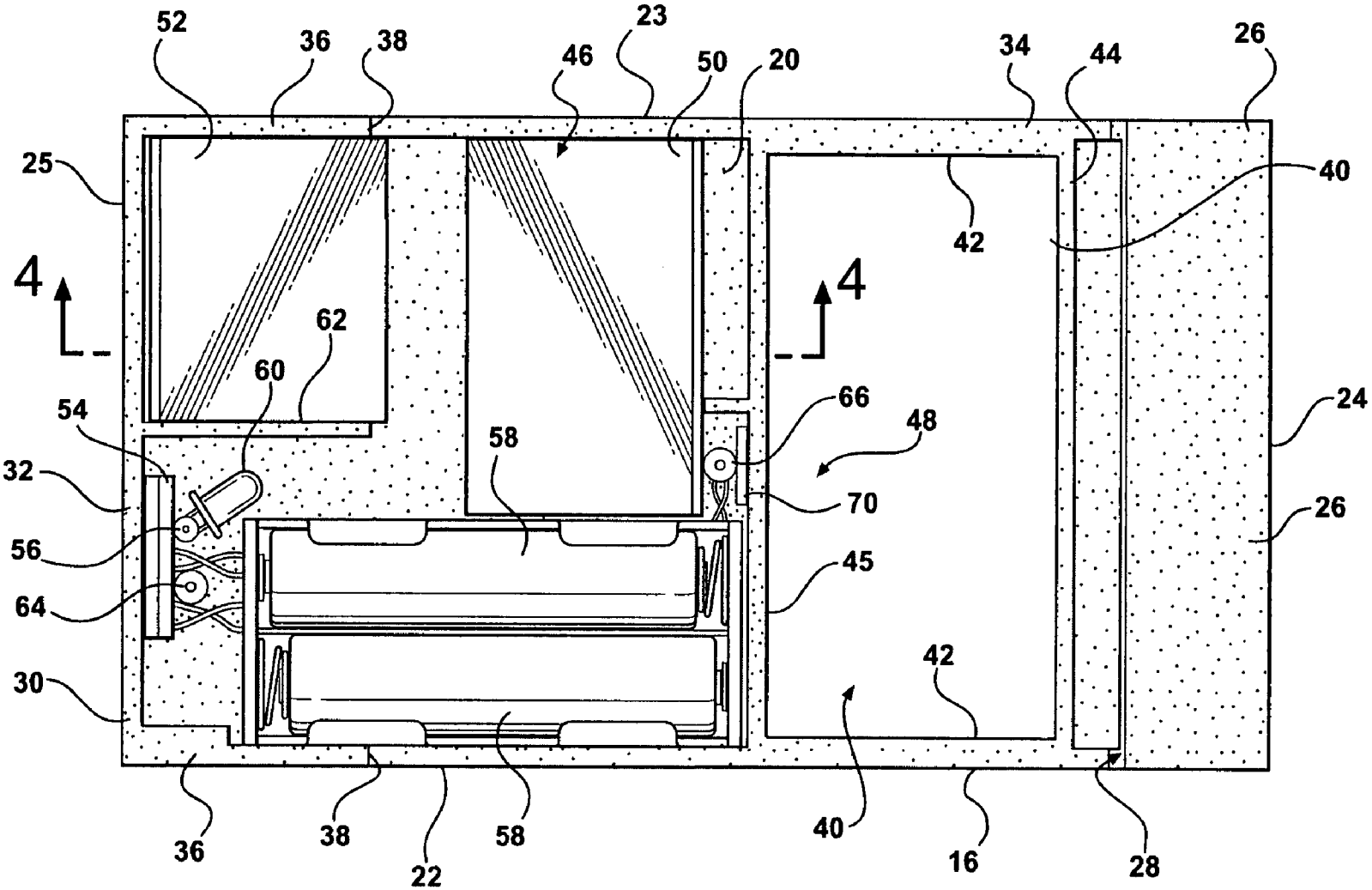
FIG. 3 is a plan view of the playing card apparatus of FIG. 2 with the cover removed therefrom.
Figure 4:
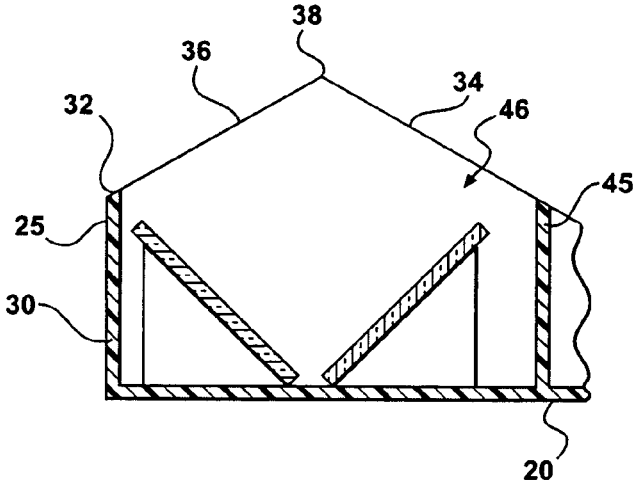
FIG. 4 is a partial cross sectional view taken generally along line 4-4 of FIG. 3.

In one presently preferred embodiment, the apparatus 10 has a housing 14, represented here, by way of example and without limitations, as having a base 16 and a cover 18 preferably detachable from one another. As shown in FIG. 3, the base 16 has a bottom surface 20 extending between a pair of laterally spaced sides 22, 23, and between front and rear ends 24, 25. The front end 24 preferably has an inclined ramped nose surface portion 26 with a pocket 28 (FIGS. 2 and 3) extending therein generally laterally between the sides 22, 23 to facilitate releasably attaching the cover 18 to the base 16. The rear end 25 is defined by a back wall 30 extending upwardly from the bottom surface 20 to an upper surface 32 extending between the sides 22, 23.

The sides 22, 23 extend upwardly from the bottom surface 20, preferably in generally parallel relation to one another, and are preferably spaced from one another a distance greater than a standard width of a single playing card. As shown in FIGS. 2 and 3, the sides 22, 23 have upper edges defining inclined forward edges 34 in mirrored relation to one another and inclined rearward edges 36 in mirrored relation to one another. The forward edges 34 extend upwardly from the front end 24 toward the rear end 25 at an inclination preferably of about 25-30 degrees from the bottom surface 20. The rearward edges 36 extend upwardly from the upper surface 32 of the back wall 30 toward the front end 24 at an inclination preferably at about 15-30 degrees from the bottom surface 20. As such, the forward and rearward edges 34, 36 converge at an apex 38.

The housing 14 preferably has an opening 40 therethrough to prevent a playing card from being concealed therebeneath. The opening 40 is represented here, for example, as extending generally centrally through a front portion of the housing 14. The opening 40 is defined here, for example, by a pair of opposite laterally spaced inner walls 42 and a pair of laterally spaced forward and intermediate walls 44, 45, respectively, extending upwardly from the bottom surface 20 to upper edges that are preferably coplanar with the forward edges 34 of the sides 22, 23.

The intermediate wall 45 is preferably located generally between the apex 38 and the front end 24 to partially define a compartment 46 between the intermediate wall 45 and the back wall 30. The compartment 46 is preferably sized to receive a control circuit 48, a first or forward mirror 50 and a second or rearward mirror 52.

The forward mirror 50 and rearward mirror 52 are arranged to communicate reflections between one another, and are represented here, by way of example and without limitations, as extending from one side 23 of the base 16 toward the other side 22. The forward mirror 50 extends upwardly from the bottom surface 20 toward the front end 24 at an inclination of about 35-45 degrees from the bottom surface 20, while the rearward mirror 52 extends upwardly from the bottom surface 20 toward the rear end 25 at an angle of about 35-45 degrees from the bottom surface 20. As such, a 90-110 degree included angle is preferably defined between reflecting surfaces of the mirrors 50, 52. The mirrors 50, 52 can be provided as standard mirror glass, or as any other suitable reflective surface, including polymeric materials having a reflective film or surface layer deposited thereon, for example.

Figure 7:
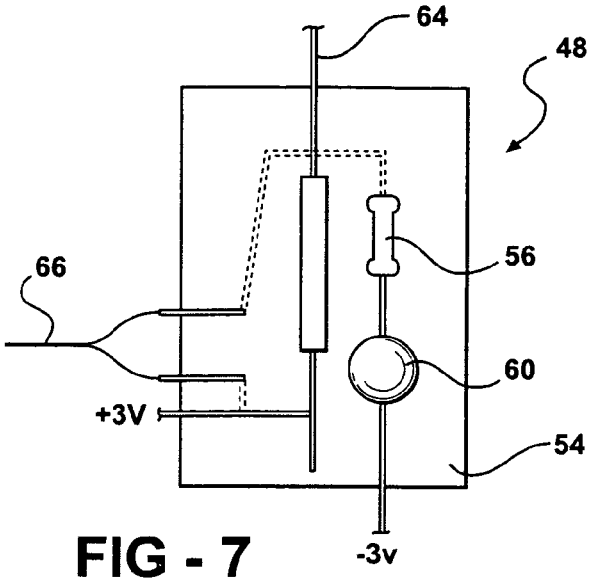
FIG. 7 is a partial view of a control circuit constructed according to one presently preferred embodiment.

As shown in FIG. 7, the control circuit 48 has a circuit board 54, represented here, for example and without limitations, as being mounted to the back wall 30 (FIGS. 2 and 3). A resistor 56, such as a 10 ohm ¼ watt resistor, for example, is attached to the circuit board 54 for electrical communication via wiring with a DC power supply, represented here, by way of example and without limitations, as a pair of 1.5V standard AAA size batteries 58 arranged in a series connection, and a light source, such as a LED 60 rated at 720 mcd at 20 mA, readily purchased from Radio Shack® under part #276-350, by way of example and without limitations. The LED 60 is preferably oriented to face toward the forward mirror 50 to direct emitted light onto the reflecting surface of the forward mirror 50. To facilitate preventing the emitted light illuminated from the LED 60 from being directly illuminated onto the rearward mirror 52, preferably an opaque partition 62 (FIGS. 2 and 3) extends between the LED 60 and the rearward mirror 52. The partition 62 is shown here, by way of example and without limitations, as extending from the back wall 30 a predetermined distance to shield the rearward mirror 52 from direct exposure to the light emitted directly from the LED 60, while allowing the light from the LED 60 to impinge the forward mirror 50.

Figure 8:
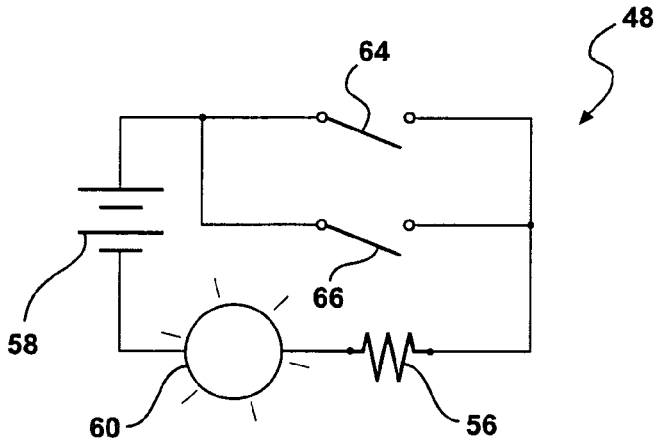
FIG. 8 is a schematic electrical diagram of the control circuit.

As shown in FIGS. 2, 7 and 8, at least one, and shown here, by way of example and without limitations, as a pair of first and second magnetic reed switches 64, 66, are incorporated in the control circuit 48 to facilitate closing and opening the control circuit 48, thereby actuating the LED 60 between on and off states, respectively. The reed switches 64, 66 are actuatable to close preferably upon encountering a magnetic field, such as that emitted from a standard magnet 68 (FIGS. 9-12), represented here, by way of example and without limitations, as being about the size of a quarter. The reed switches 64, 66 are arranged in parallel with one another, and thus, if either of the reed switches 64, 66 is closed via a magnetic force, an electrical circuit is completed, thereby causing the LED 60 to illuminate. One of the reed switches, referred to hereafter as the preliminary reed switch 64, is preferably attached to the circuit board 54 generally adjacent the back wall 30, and is preferably offset toward one of the sides 22 away from the rearward mirror 52. The other reed switch, referred to hereafter as the playing reed switch 66, is preferably carried by the intermediate wall 45. The playing reed switch 66 is shown here, by way of example and without limitations, as being mounted to a ferrous plate 70 that is attached to the intermediate wall 45 generally between the sides 22, 23. Otherwise, for example, in another exemplary embodiment, the ferrous plate 70 (FIG. 6) could be mounted to the underside of the cover 18, and the playing reed switch 66 could be mounted directly to the intermediate wall 45, preferably beneath the ferrous plate 70. Additionally, the ferrous plate 70 could extend continuously from an area generally near the intermediate wall 45 to the area near the preliminary reed switch 64, such that a magnetic force from a magnet placed adjacent the intermediate wall 45 could be transmitted via the ferrous plate 70 to actuate the preliminary reed switch 64 adjacent the back wall 30. As such, the need to incorporate the playing reed switch 66 could be eliminated. It should also be recognized that the reed switches 64, 66 could be replaced with an on/off toggle switch, or any other switch, as desired.

Figure 5:
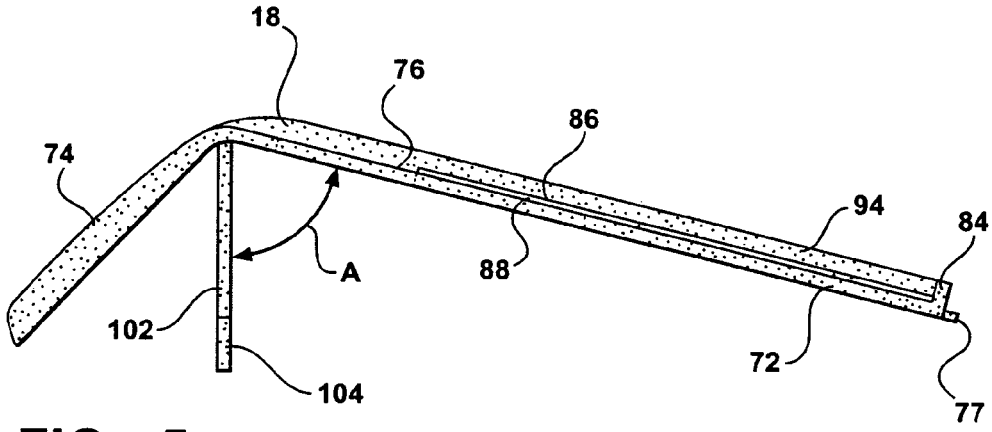
FIG. 5 is a side view of the cover constructed according to one presently preferred embodiment.
Figure 6:
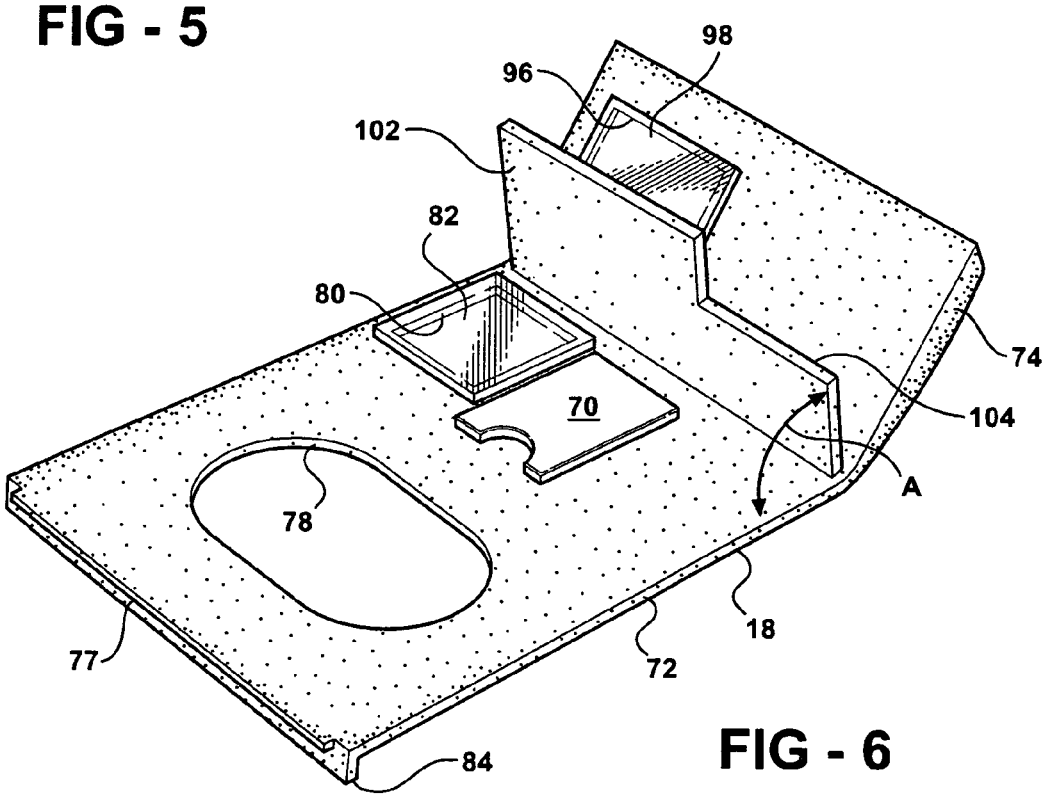
FIG. 6 is a bottom perspective view of the cover.

As shown in FIGS. 5 and 6, the cover 18 has a pair of walls 72, 74 inclined relative to one another. One of the walls, referred to hereafter as a forward wall 72, provides an inclined playing card support surface 76 (FIG. 5) sized to overlie the forward edges 34 of the sides 22, 23, and another of the wall surfaces, referred to hereafter as a rearward wall 74, is sized to overlie the rearward edges 36 of the sides 22, 23. The forward and rearward walls 72, 74 are inclined relative to one another such that they lie generally flat over the respective forward and rearward edges 34, 36. The cover 18 can be formed as a single piece of material, or the forward and rearward walls 72, 74 can be joined to one another along a common seem, such as through a weld joint or adhesive, for example.

The forward wall 72 preferably has a leading front protrusion or tongue 77 sized for receipt in the pocket 28 of the nose portion 26 to facilitate releasable attachment of the cover 18 to the base 16. An opening 78 is preferably formed in the forward wall 72 to form in part the through opening 40 in the housing 14. Another opening, referred to as first opening 80, is formed in the forward wall 72 to overlie at least a portion of the forward mirror 50 when the cover 18 is attached to the base 16. The first opening 80 is sized to allow at least one playing card value, and preferably a pair or more playing card values, to be placed adjacent one another within the space of the first opening 80. The first opening 80 preferably has a light transmissive window 82 therein, wherein the window 82 is preferably constructed from a non-reflective material, such as frosted glass or frosted plastic, for example, though a clear piece of plastic or glass could be used. As such, the playing cards 12 are preferably required to be placed in contact with the window 82 in order to emit a reflection onto the forward mirror 50, and thus, to be visible via the apparatus 10.

The forward wall 72 preferably has an upstanding, laterally extending edge or lip 84 adjacent the tongue 77. The lip 84 facilitates preventing the playing cards 12 from sliding along the slope of the forward wall 72 upon being placed thereon. To facilitate locating the playing cards 12 laterally on the forward wall 72, such that the value of the cards 12 is positioned in the intended area over the window 82, the forward wall 72 preferably has a raised surface or platform 86 extending upwardly a distance preferably equal to or slightly greater than a thickness of a playing card along a side of the forward wall 72 adjacent the window 82. The platform 86 defines an upstanding abutment 88 to locate the value of one of the cards 12, referred to hereafter as a first playing card 90 (FIGS. 9-12), over approximately one-half of the window 82 when a side edge of the first playing card 90 is in contact with the abutment 88. To facilitate locating another of the cards 12, referred to hereafter as a second playing card 92, laterally on the forward wall 72 in an overlying relation with the first playing card 90, preferably an upstanding edge or lip 94 extends along a side of the forward wall 72. The lip 94 is laterally spaced relative to the abutment 88 such that when a side edge of the second playing card 92 is placed in contact with the lip 94, the value of the second playing card 92 is located approximately over another half of the window 82 opposite the half occupied by the first playing card 90. As such, the values of the first and second playing cards 90, 92 are both located over and within the boundary of the window 82, and thus, over the forward mirror 50.

The rearward wall 74 has an opening, referred to as a second opening 96, arranged to overlie at least a portion of the rearward mirror 52 when the cover 18 is attached to the base 16. The second opening 96 is inclined relative to the first opening 80 and is sized to allow a player to view the values of the first and second playing cards 90, 92 reflected from the forward mirror 50 onto the rearward mirror 52. The second opening 96 preferably has a protective light transmissive card value viewing window 98 received therein. The window 98 is preferably tinted to prevent viewing of the card values unless the LED 60 is illuminated, though a clear piece of plastic or glass could be used. An upstanding rear lip 100 (FIGS. 9-12) is preferably formed adjacent a back edge of the rearward wall 74 to facilitate preventing the magnet 68 from sliding off the rearward wall 74 when placed thereon, as shown in FIGS. 9 and 10.

As shown in FIGS. 5 and 6, the cover 18 preferably has an opaque baffle 102 extending downwardly for receipt with the compartment 46 of the base 16 upon releasably attaching the cover 18 to the base 16. The baffle 102 preferably extends along the seam defined between the forward wall 72 and the rearward wall 74 at an included angle A of about 72-80 degrees from the forward wall 72. The baffle 102 is preferably sized to form a close or snug fit between the sides 22, 23 of the base 16, and is shown here, by way of example, as having a recessed or notched section 104 to accommodate the batteries 58. The baffle 102 extends downwardly a sufficient distance to prevent an image from being viewed directly from the forward mirror 50 through the viewing window 98. As such, persons standing in front of the apparatus 10 are prevented from seeing a reflection of the card values directly from the forward mirror 50. Accordingly, for the player to see the playing card values, generally the player must look vertically downwardly into the card value viewing window 98 to see the reflection of the card values from the rearward mirror 52.

Figure 9:
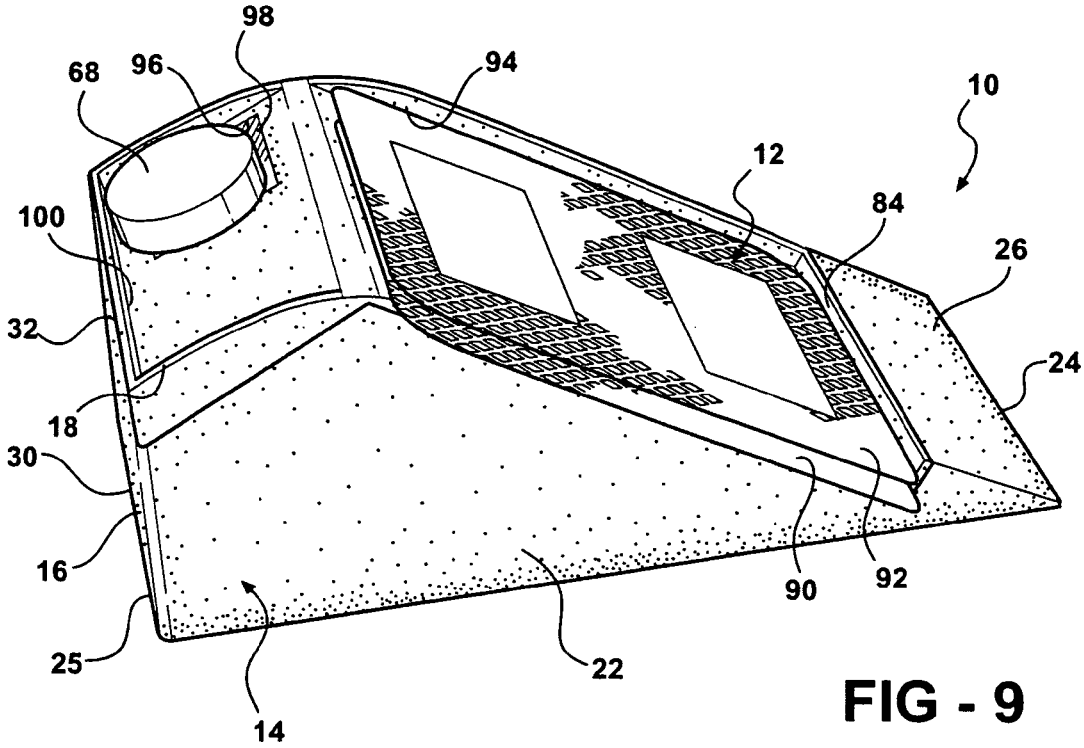
FIG. 9 is a view similar to FIG. 1 with the pair of playing cards disposed face down on the playing card apparatus in a non-viewing mode.

As shown in FIG. 9, the first and second playing cards 90, 92 are preferably slid from a table top surface up the inclined nose section 26 onto the playing card support surface in staggered relation to one another. The underlying first playing card 90 contacts the abutment 88 so that the value of the first playing card 90 is automatically positioned over approximately one-half of the window 82. The overlying second playing card 92 is positioned in abutment with the lip 94 along the side of the forward wall 72, thereby automatically positioning the value of the second playing card 92 over the remaining half of the window 82. At this time, the magnet 68 is preferably located or stowed over the card value viewing window 98, thereby being out of magnet communication with the reed switches 64, 66. As such, the reed switches 64, 66 of the electrical circuit remain open, thus, causing the LED 60 to remain in a non-illuminated state. Accordingly, the values of the playing cards 90, 92 can not be viewed through the window 98. It should be recognized that the same is true when the magnet 68 is stowed other than on the window 98 and out of magnetic contact with the reed switches 64, 66.

Figure 10:
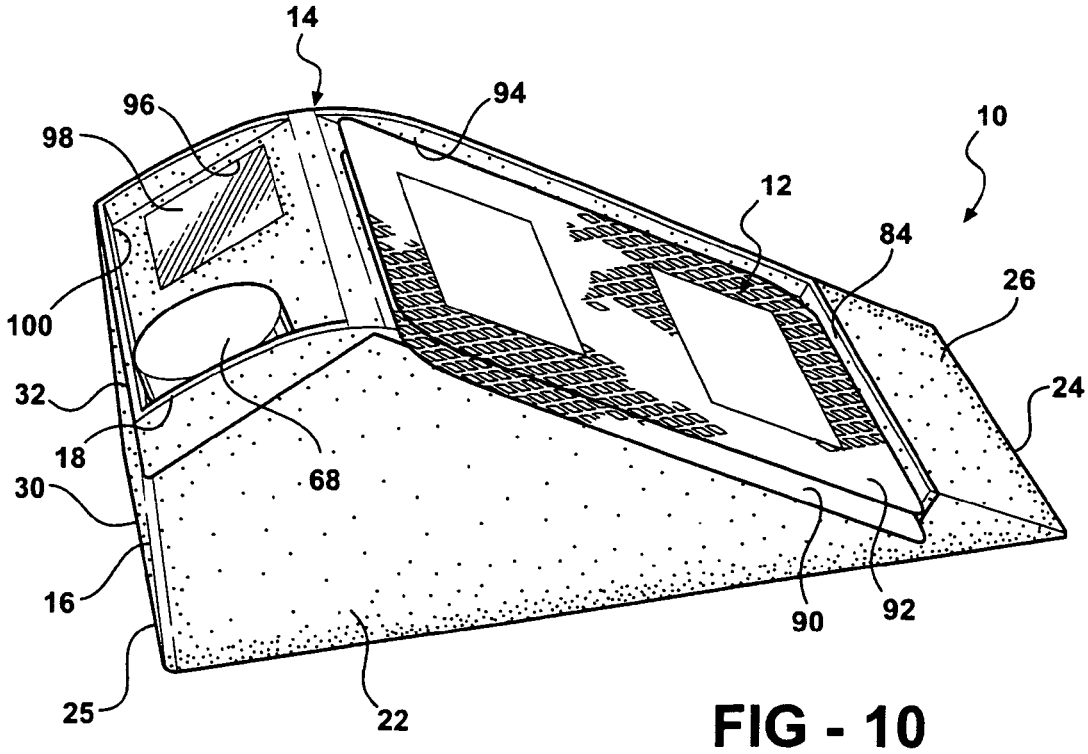
FIG. 10 is a view similar to FIG. 9 with the playing card apparatus in a preliminary viewing mode.
Figure 12:
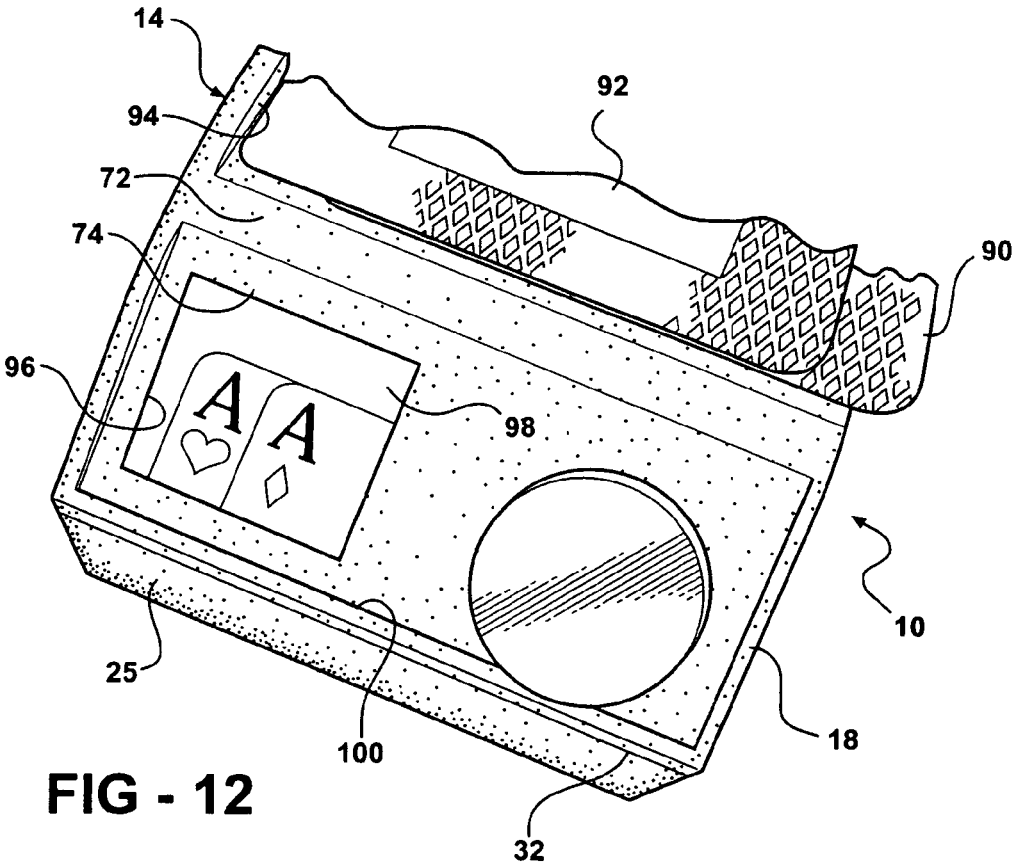
FIG. 12 is a view looking downwardly into a viewing window of the playing card apparatus while in the preliminary viewing mode.

As shown in FIG. 10, the magnet 68 is moved to a preliminary viewing position adjacent the viewing window 98, such that the magnet 68 is positioned or slid over the preliminary reed switch 64 and in magnetic communication therewith. As such, the reed switch 64 is closed, thereby completing the circuit, and thus, causing the LED 60 to be illuminated. Accordingly, the values of the playing cards 90, 92 can be seen by a player looking generally straight down into the viewing window 98, as illustrated in FIG. 12.

Figure 11:
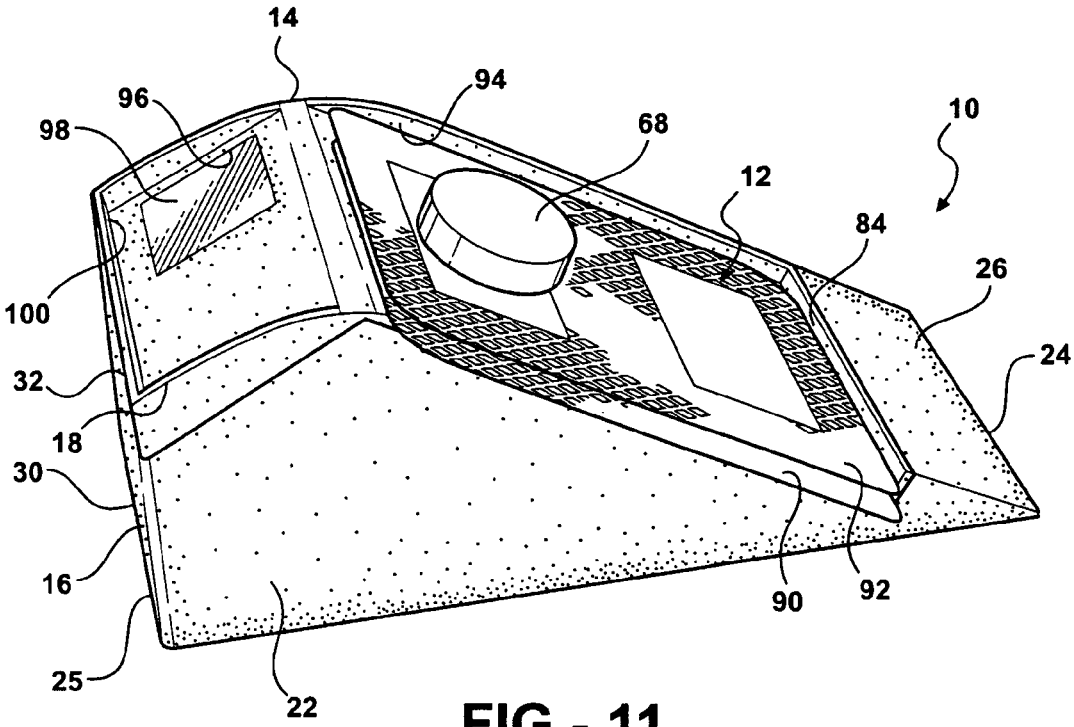
FIG. 11 is a view similar to FIG. 9 with the playing card apparatus in a play indicating viewing mode.

As shown in FIG. 11, if the player wishes to play the cards 90, 92, and thus, continue participating in the game, the player can move the magnet 68 above the playing reed switch 66, where upon the magnet 68 is maintained in position via the magnetic attractive force established between the magnet 68 and the ferrous plate 70. Generally, it is customary that the poker player place an object on top of the cards to indicate that they wish to play their cards and remain in the game. With the magnet 68 positioned over the reed switch 66, the reed switch 66 is closed, and the LED 60 is illuminated such that the playing card values remain visible to the player through the viewing window 98. As previously mentioned, the reed switch 66 could be eliminated if the ferrous plate 70 is extended continuously from an area generally adjacent the intermediate wall 45 to an area generally adjacent the reed switch 64.

It should be recognized that the housing 14 provides a mechanism in which to support the playing cards 12 above the forward and rearward mirrors 50, 52, and that the invention could be practiced with a housing having a modified geometry from that shown in the drawings. For example, and without limitations, rather than the sides 22, 23 being constructed as part of the base 16, the sides 22, 23 could be formed as part of the cover 18, with one or more of the internal components being attached to one of the cover or base.

Figure 13:
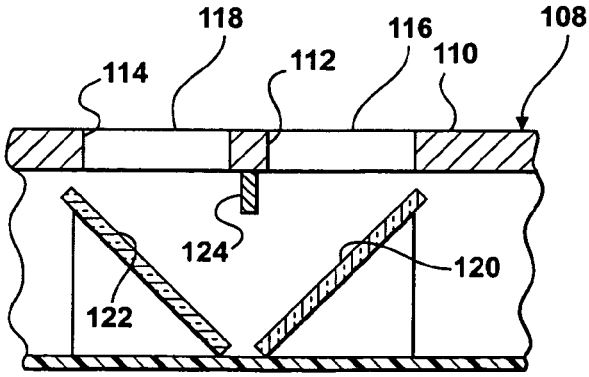
FIG. 13 is a partial schematic cutaway side view of a playing card apparatus constructed according to another presently preferred embodiment.

In another embodiment, the housing could be otherwise constructed as shown in FIG. 13, wherein the housing could comprise, at least in part, a table top 108, with an upper surface of the table top defining a playing card support surface 110. The table top 108 has at least one, and shown here as a pair of openings 112, 114, preferably with a frosted window 116 and tinted window 118 therein. A first or forward mirror 120 and a second or rearward mirror 122 are located beneath the respective windows 116, 118 in the table top 108, with the mirrors 120, 122 having a baffle 124 located therebetween. The forward and rearward mirrors 120, 122 are arranged substantially the same as in the previous embodiment such that a player can view the values of their playing cards 12 via a reflection from the forward mirror 120 to the rearward mirror 122 by positioning the values of the playing cards 12 face down on the frosted window 116 over the forward mirror 120. A control circuit, such as discussed above (not shown), is incorporated to allow a source of illumination, such as an LED (not shown), for example, to be actuated, when desired. Otherwise, the apparatus functions generally the same as in the previous embodiment; and thus, is not discussed further.

The embodiments discussed above and illustrated in the drawings are intended to be representative of presently preferred embodiments of the invention, and thus, are intended to be illustrative rather than definitive thereof. Persons having ordinary skill in the art will readily recognize other embodiments within the spirit and scope of the invention. The invention is defined by the following claims.

I claim:

1. A playing card apparatus for discreetly displaying values on faces of playing cards to a player, comprising:

a housing having a playing card support surface with at least one opening over which the playing cards are placed face down;

a first mirror positioned below said at least one opening to reflect an image of the playing card values in one direction while in their face down orientation; and a second mirror positioned below said at least one opening to reflect the image from said first mirror upwardly through said at least one opening for discreet viewing by the player wherein said playing card support surface has an inclined ramp surface to facilitate sliding the playing cards into position on said housing.

2. A playing card apparatus for discreetly displaying values on faces of playing cards to a player, comprising:

a housing having a forward inclined playing card support surface with a first opening over which the values of the playing cards are placed face down, a rearward inclined surface with a second opening through which the value of the playing cards can be viewed, the rearward surface being inclined relative to said playing card support surface;

a first mirror positioned below said first opening to reflect an image of the playing card values in one direction while in their face down orientation; and a second mirror positioned below said second opening to reflect the image from said first mirror upwardly through said second opening for discreet viewing by the player.

3. The playing card apparatus of claim 2 including a source of illumination received in said housing and being arranged to impinge said first mirror with a beam of light upon being illuminated.

4. The playing card apparatus of claim 3 further including an electrical circuit in electrical communication with said source of illumination, said electrical circuit having a first reed switch that is actuatable via a magnetic field to illuminate said source of illumination.

5. The playing card apparatus of claim 4 further including a second reed switch that is actuatable via a magnetic field, said second reed switch being in electrical communication with said source of illumination and being arranged in parallel with said first reed switch.

6. The playing card apparatus of claim 3 wherein said second opening has a tinted window therein to prevent viewing of the playing cards values unless said source of illumination is in its illuminated state.

7. The playing card apparatus of claim 2 wherein said forward inclined playing card support surface has a raised surface defining an abutment positioned to contact one playing card to automatically orient the value of the playing card over one-half of the first opening.

8. The playing card apparatus of claim 7 wherein said forward inclined playing card support surface has an upstanding lip laterally spaced from said abutment a predetermined distance to automatically orient the value of said another playing card over another half of the first opening.

9. A method of concealing and displaying playing cards, comprising the steps of:

placing at least one playing card face down on a housing, said housing having a playing card support surface and at least one opening sized to view the value of the playing cards therethrough, a first mirror positioned below said at least one opening to reflect an image of the playing card values in one direction and a second mirror positioned below said at least one opening to reflect the image from said one direction upwardly through said at least one opening; and viewing the value of said at least one playing card through said at least one opening.

10. The method of claim 9 including illuminating an interior portion of said housing while viewing the playing card value.

11. The method of claim 10 including applying a magnetic field to said housing to actuate the illumination.

12. The method of claim 10 wherein the placing step includes sliding the playing card up an inclined surface of the housing.

* * * * *

UNITED STATES PATENT AND TRADEMARK OFFICE

CERTIFICATE OF CORRECTION

PATENT NO. : 7,575,235 B2
APPLICATION NO. : 11/322009
DATED : August 18, 2009
INVENTOR(S) : Francis G. Belill It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 626 days.

Signed and Sealed this

Seventh Day of September, 2010

David J. Kappos

David J. Kappos
*Director of the United States Patent and Trademark Office*